US009416490B2

(12) United States Patent
Duggirala et al.

(10) Patent No.: US 9,416,490 B2
(45) **Date of Patent: *Aug. 16, 2016**

(54) CROSS-LINKED GLYCEROL BASED POLYMERS AS DIGESTION AIDS FOR IMPROVING WOOD PULPING PROCESSES

(71) Applicant: NALCO COMPANY, Naperville, IL (US)

(72) Inventors: Prasad Y. Duggirala, Naperville, IL (US); Xiaojin Harry Li, Palatine, IL (US)

(73) Assignee: NALCO COMPANY, Naperville, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/758,299

(22) Filed: Feb. 4, 2013

(65) Prior Publication Data

US 2013/0139981 A1 Jun. 6, 2013
US 2016/0215449 A9 Jul. 28, 2016

Related U.S. Application Data

(63) Continuation-in-part of application No. 12/720,973, filed on Mar. 10, 2010, now Pat. No. 8,366,877, and a continuation-in-part of application No. 13/484,526, filed on May 31, 2012, now Pat. No. 8,884,049, and a continuation-in-part of application No. 13/560,771, filed on Jul. 27, 2012, now Pat. No. 8,728,275.

(51) Int. Cl.
*D21C 3/22* (2006.01)
*D21C 3/28* (2006.01)
(Continued)

(52) U.S. Cl.
CPC *D21C 3/22* (2013.01); *D21C 3/222* (2013.01); *D21C 3/02* (2013.01); *D21C 3/06* (2013.01); *D21C 3/28* (2013.01)

(58) Field of Classification Search
CPC ..... D21C 3/22; D21C 3/222; D21C 3/28
USPC ..... 162/72
See application file for complete search history.

(56) References Cited

U.S. PATENT DOCUMENTS 2,023,388 A 12/1935 Harris
2,258,892 A 10/1941 Harris
(Continued)

FOREIGN PATENT DOCUMENTS

CA 2613704 A1 1/2007
CN 101186696 A 5/2008
(Continued)

OTHER PUBLICATIONS

Coyne, John F. et al., "Absorbtion of hydoxyl Organic Compounds on Alumina Trihydrate", Light Metals (1994), pp. 39-45.
(Continued)

*Primary Examiner* — Anthony Calandra
(74) *Attorney, Agent, or Firm* — Eric D. Babych; Brinks Gilson & Lione

(57) ABSTRACT

The invention provides a method of improving the digestion of wood chips into pulp. The method involves: adding a cross-linked glycerol-based polymer additive to a solution used in the digestion process. This additive is unexpectedly effective at facilitating digestion. The branched and ether structure of the additive allows it to withstand the harsh nature of a high stress environment. In addition, it is more soluble in the harsh condition than other surfactants. The structure, resistance, and particular balance between hydrophobic and hydrophilic regions, causes the additive to increases the interaction between the wood chips and the digestion chemicals. This in turn reduces the costs, the amount of additive needed, and the amount of reject wood chunks that result from the digestion process.

19 Claims, 6 Drawing Sheets

CLPG: $R_1$ = H

CLHPG: $R_1$ = hydrocarbons, acyl or H

(51) Int. Cl.

| | |
|---|---|
| *D21C 3/02* | (2006.01) |
| *D21C 3/06* | (2006.01) |

(56) References Cited

U.S. PATENT DOCUMENTS

| | | | | |
|---|---|---|---|---|
| 2,613,704 | A | 10/1952 | Sacrey et al. | |
| 3,637,774 | A | 1/1972 | Babayan et al. | |
| 4,551,561 | A | 11/1985 | Stuehler | |
| 4,968,448 | A | 11/1990 | Svarz et al. | |
| 5,032,224 | A | 7/1991 | Ahluwalia et al. | |
| 5,057,570 | A | 10/1991 | Miller et al. | |
| 5,091,159 | A | 2/1992 | Connelly et al. | |
| 5,198,532 | A | 3/1993 | Blytas et al. | |
| 5,250,152 | A | 10/1993 | Ling et al. | |
| 5,326,499 | A | 7/1994 | Wegner et al. | |
| 5,399,371 | A | 3/1995 | Harris | |
| 5,429,718 | A | 7/1995 | Morlino et al. | |
| 5,501,769 | A | 3/1996 | Blackstone et al. | |
| 5,630,985 | A | 5/1997 | Williams et al. | |
| 5,641,816 | A | 6/1997 | Klein et al. | |
| 5,716,530 | A | 2/1998 | Strominger et al. | |
| 5,728,265 | A | 3/1998 | Saint et al. | |
| 6,030,443 | A | 2/2000 | Bock et al. | |
| 6,086,771 | A | 7/2000 | Selvarajan et al. | |
| 6,133,215 | A | 10/2000 | Zelger et al. | |
| 6,228,416 | B1 | 5/2001 | Reibert et al. | |
| 6,620,904 | B2 | 9/2003 | Lemke et al. | |
| 6,683,222 | B2 | 1/2004 | Nakamura et al. | |
| 6,765,082 | B2 | 7/2004 | Sunder et al. | |
| 6,770,168 | B1 | 8/2004 | Stigsson et al. | |
| 6,822,068 | B2 | 11/2004 | Sunder et al. | |
| 7,081,183 | B2 | 7/2006 | Duggirala et al. | |
| 7,671,098 | B2 * | 3/2010 | Leinweber et al. | 516/173 |
| 7,845,097 | B2 | 12/2010 | Bobbett et al. | |
| 8,101,045 | B2 | 1/2012 | Furman et al. | |
| 8,133,922 | B2 | 3/2012 | Sakanishi et al. | |
| 8,214,358 | B2 | 7/2012 | Friedl et al. | |
| 8,236,889 | B2 | 8/2012 | Martin et al. | |
| 8,366,877 | B2 * | 2/2013 | Duggirala et al. | 162/72 |
| 2002/0035238 | A1 | 3/2002 | Nakamura et al. | |
| 2002/0058781 | A1 | 5/2002 | Lemke et al. | |
| 2003/0092879 | A1 | 5/2003 | Sunder et al. | |
| 2003/0120022 | A1 | 6/2003 | Sunder et al. | |
| 2003/0124710 | A1 | 7/2003 | Borch et al. | |
| 2004/0016526 | A1 | 1/2004 | Duggirala et al. | |
| 2006/0281931 | A1 | 12/2006 | Leinweber et al. | |
| 2006/0286052 | A1 | 12/2006 | Oki et al. | |
| 2008/0282579 | A1 | 11/2008 | Bobbett et al. | |
| 2008/0306211 | A1 | 12/2008 | Lemke et al. | |
| 2009/0013006 | A1 | 1/2009 | Friedl et al. | |
| 2009/0082483 | A1 | 3/2009 | Petrovic et al. | |
| 2009/0130006 | A1 | 5/2009 | Wang et al. | |
| 2009/0239958 | A1 | 9/2009 | Sakanishi et al. | |
| 2010/0212847 | A1 | 8/2010 | Hamers et al. | |
| 2010/0292380 | A1 | 11/2010 | Martin et al. | |
| 2011/0092743 | A1 | 4/2011 | Li et al. | |
| 2011/0094695 | A1 | 4/2011 | Jiang et al. | |
| 2011/0162811 | A1 | 7/2011 | Furman et al. | |
| 2011/0220307 | A1 * | 9/2011 | Duggirala et al. | 162/77 |
| 2012/0238776 | A1 * | 9/2012 | Li et al. | 560/187 |

FOREIGN PATENT DOCUMENTS

| | | | |
|---|---|---|---|
| DE | 10307172 | A1 | 5/2005 |
| EP | 0568229 | | 11/1993 |
| EP | 719752 | B1 | 3/2008 |
| JP | 03717193 | | 11/2005 |
| WO | WO9641915 | | 12/1996 |
| WO | 9920828 | | 4/1999 |
| WO | 9929626 | | 6/1999 |
| WO | 2004074346 | A1 | 9/2004 |
| WO | 2006033321 | A1 | 3/2006 |
| WO | 2007003276 | A1 | 1/2007 |
| WO | WO 2007/002553 | | 1/2007 |
| WO | 2007049950 | A2 | 5/2007 |
| WO | 2007049950 | A3 | 9/2007 |
| WO | WO 2008/013875 | A2 | 1/2008 |

OTHER PUBLICATIONS

Kildea, John D. et al., "Scale colntrol and prevention of hydrate precipitation in red mud filters", Light Metals (2000), 105-110.

Markova, D. et al., "Synthesis of novel poly(vinyl methyl ether) copolymers by alkylation of poly(vinyl acetate) and poly(vinyl alcohol)," Polymer International, 2003, 52 pp. 1600-1604.

Rossitter et al., The Mechanism of Sodium Gluconate Poisoning of Gibbsite Precipitation:, Chemical Engineering Research and Design (1996). 74(A7), 828-834.

Sunder et al., "Chiral Hyperbranched Dendron-Analogs", Macromolecules (2000), 33, 253-254.

Sunder et al., "Controlled Synthesis of Hyperbranched Polyglycerols by Ring-Opening Multibranching Polymerization", Macromolecules (1999), 32, 4240-4246.

* cited by examiner

CROSS-LINKED GLYCEROL BASED POLYMERS AS DIGESTION AIDS FOR IMPROVING WOOD PULPING PROCESSES

CROSS-REFERENCE TO RELATED APPLICATIONS

This application is a Continuation In-Part of U.S. patent application Ser. No. 12/720,973 filed on Mar. 10, 2010 and is also a Continuation In-Part of U.S. patent application Ser. No. 13/560,771 filed on Jul. 27, 2012 and of U.S. patent application Ser. No. 13/484,526.

STATEMENT REGARDING FEDERALLY SPONSORED RESEARCH OR DEVELOPMENT

Not Applicable.

BACKGROUND OF THE INVENTION

This invention relates to compositions of matter and methods of digesting wood chips used in paper pulping processes. The digestion is often achieved by chemical, mechanical or combined means. Chemical pulping is currently dominated in pulping industry, and among Kraft pulping is the most used pulping process. Chemical digestion is a process in which cellulosic raw materials such as wood chips are treated with chemicals including alkaline and sulfide for Kraft pulping or sulfites/bisulfites for sulfite pulping, usually at high pressure and temperature for the purpose of removing impurities and producing pulp suitable for papermaking. The mixture of chemicals is predominantly in a liquid form and is sometimes referred to as white liquor in Kraft pulping. Wood chips which consist primarily of cellulose, hemicellulose, lignin, and resins are broken down by digestion into a pulp of cellulose and hemicellulose fibers. The lignin and resins, which are undesirable in paper, are at least partially removed in the delignification stage of digestion.

The digestion process can be enhanced by the presence of one or more surfactants in the white liquor in Kraft pulping. The surfactants reduce the surface tension at the interface between the white liquor and the wood chips. This reduced surface tension allows the chemicals in the white liquor to penetrate more deeply into the wood chips and thereby better digest. Unfortunately the optimal composition of white liquor impairs the effectiveness of the surfactants. Because white liquor has a high pH, it causes most surfactants to salt out of solution especially in high temperatures and pressures. This reduces the amount of surfactant effective on the wood chips. Reducing the amount of surfactant causes wood chunks (known as rejects) to survive the digestion process which imposes additional costs and quality control issues in subsequent papermaking stages. Attempting to overcome this problem by supersaturating the white liquor with surfactant has been shown to offer little improvement and is undesirably expensive. Similarly, lowering the temperature, pressure, or pH of the white liquor, also results in more rejects surviving digestion.

Thus there is a clear need for, and utility in an improved method of digesting wood chips into paper pulp. The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

BRIEF SUMMARY OF THE INVENTION

At least one embodiment of the invention is directed towards a method for enhancing the penetration of cooking liquor into wood chips. The method comprises cooking wood chips in a cooking liquor to form a paper pulp and including at least one cross-linked glycerol-based polymer comprising additive in the cooking liquor. The method so enhances the penetration of pulping liquor into the chips that it reduces lignin such that the resulting pulp has a lower kappa number than if no polymer or if equal amounts of other glycerol based polymers were added to the liquor. The polymer may have a branched structure, the branched structure characterized as having at least three chain segments of the polymer joined at a single joining monomer of the polymer which has an alkoxylate group. At least one of the chain segments may comprise a lipophilic carbon bearing group and this chain segment is engaged to the joining monomer at a location other than the alkoxylate group of the joining monomer. The additive may be a cross-linked glycerol-based polymer having branched and cyclic structures according to the structure:

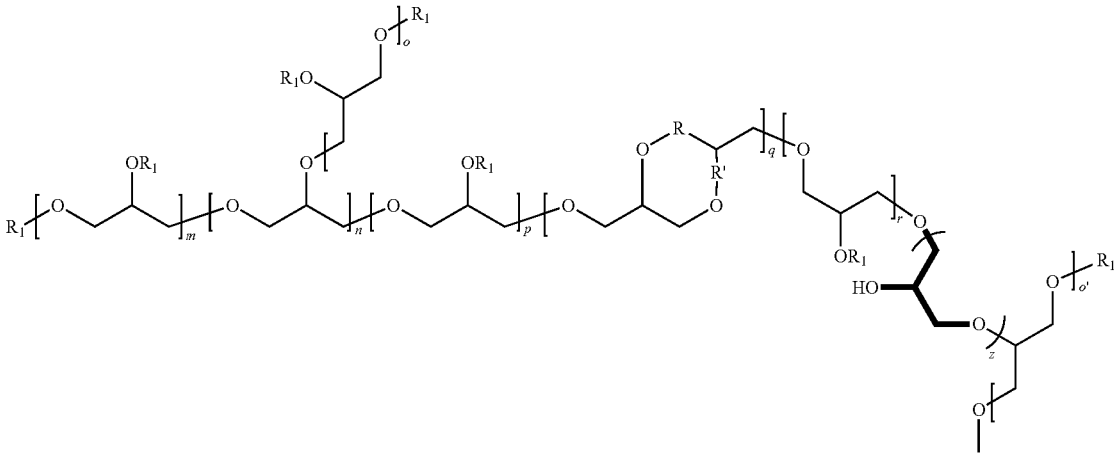

-continued

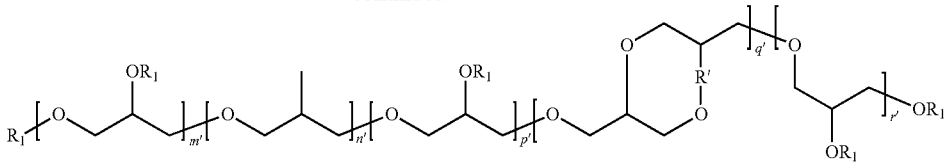

wherein m, n, o, and p are each independently between 1 and 700 and, q and r are independently a number of 0 and integers of between 1-700, R and R' are $(CH_2)_n$ and n can independently be 1 or 0, Z can be 0 or great than 0 and each $R_1$ is independently H, acyl, or a C1-C40 hydrocarbon group, which may be optionally substituted.

The additive may consist essentially of a cross-linked lipohydrophilic polyglycerol solution and/or may be selected from the list of crosslinked lipohydrophilic crosslinked polyglycerols, crosslinked polyglycerol derivatives, and other crosslinked glycerol-based polymers and any combinations thereof. The glycerol-based polymers may be branched, hyperbranched, dendritic, cyclic and any combinations thereof. The additive may be added to the cooking liquor in an amount of less than 1% or in an amount of 0.05 to 0.001% based on the dried weight of the chips. The additive may reduce the amount of lignin in the produced paper pulp by at least at least 0.5%.

The digestion process may be one selected from the list consisting of: Kraft digestion, sulfite pulping, oxygen pulping, semichemical pulping, mechanical pulping, thermal pulping, thermomechanical pulping, pulping designed for conversion into synthetic fibers such as dissolving grade pulps, and any combinations thereof. The cooking liquor may also comprise additional surfactant(s).

The cross-linked glycerol-based polymers may be used by combining with anthraquinone, anthraquinone derivatives, quinone derivatives, polysulfide and the like and any combinations thereof. The cross-links may be formed by reaction between a glycerol-based polymer and diisocyanates, N,N-methylenebis(meth)acrylamide, polyethyleneglycol di(meth)acrylate, glycidyl(meth)acrylate, dialdehydes such as glyoxal, di- or tri-epoxy compounds such as glycerol diglycidyl ether and glycerol triglycidyl ether, dicarboxylic acids and anhydrides such as adipic acid, maleic acid, phthalic acid, maleic anhydride and succinic anhydride, phosphorus oxychloride, trimetaphosphates, dimethoxydimethsilane, tetraalkoxysilanes, 1,2-dichloroethane, 1,2-dibromoethane, dichloroglycerols 2,4,6-trichloro-s-triazine, epichlorohydrin, and any combination thereof. The cross-linked glycerol-based polymers may comprise at least one of the structural units illustrated in FIG. 2. The cross-linked glycerol-based polymers may comprise copolymers containing non-glycerol based structural units. The additive may consist essentially of a cross-linked polyglycerol solution. The cooking liquor may be white liquor. The crosslinked glycerol-based polymer may increase the pulping yield.

At least one embodiment of the invention is directed towards a method for enhancing the penetration of cooking liquor into wood chips, the method comprising cooking wood chips in a cooking liquor to form a paper pulp and including at least one cross-linked lipohydrophilic glycerol-based polymer additive in the white liquor, wherein the polymer has a branched structure, the branched structure characterized as having at least three chain segments of the polymer joined at a single joining monomer of the polymer which has an alkoxylate group, and in which at least one of the chain segments comprises a lipophilic carbon bearing group and this chain segment is engaged to the joining monomer at a location other than the alkoxylate group of the joining monomer, the method so enhances the penetration of pulping liquor into the chips that it reduces lignin such that the resulting pulp has a lower kappa number than if no polymer or if equal amounts of other glycerol used polymers were added to the liquor.

BRIEF DESCRIPTION OF THE DRAWINGS

A detailed description of the invention is hereafter described with specific reference being made to the drawings in which.

For the purposes of this disclosure, like reference numerals in the figures shall refer to like features unless otherwise indicated. The drawings are only an exemplification of the principles of the invention and are not intended to limit the invention to the particular embodiments illustrated.

DETAILED DESCRIPTION OF THE INVENTION

Figure 1:
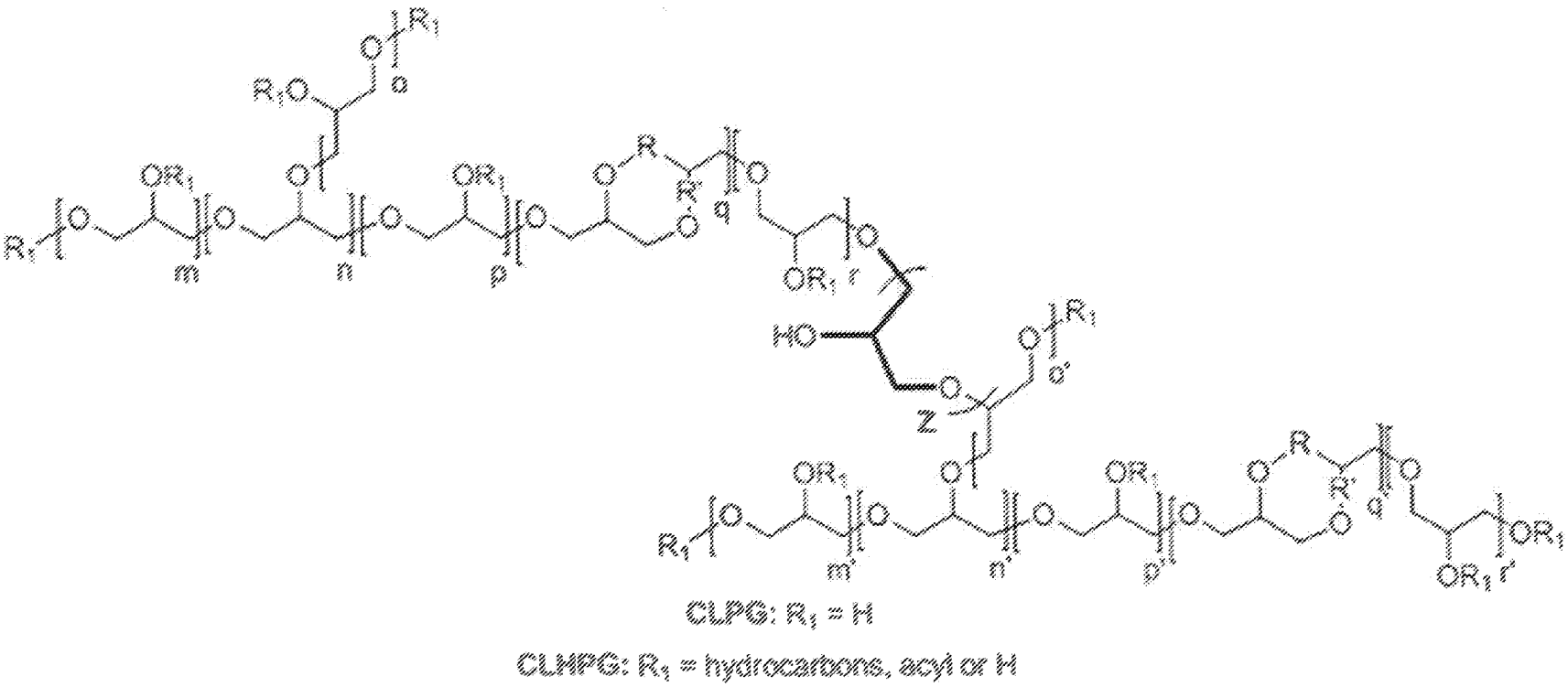
FIG. 1 is an illustration of a cross-linked glycerol-based polymer.

The following definitions are provided to determine how terms used in this application, and in particular how the claims, are to be construed. The organization of the definitions is for convenience only and is not intended to limit my of the definitions to any particular category "Acyl" means a substituent having the general formula —C(O)R, wherein R is alkyl, alkenyl, alkynyl, aryl, heteroaryl or heterocyclyl, any of which may be further substituted "Alkyl" means a linear, branched, or cyclic saturated hydrocarbon group, such as a methyl group, ethyl group, n-propyl group, isopropyl group, n-butyl group, isobutyl group, tert-butyl group, n-pentyl group, isopentyl group, n-hexyl group, isohexyl group, cyclopentyl group, cyclohexyl group, and the like. Alkyl groups may be optionally substituted.

"Alkoxylate group" means the single bonded carbon and oxygen bearing group engaged to a glycerol monomer in a glycerol-based polyoxyalkylene polymer, as described in U.S. Pat. No. 5,728,265.

"Branched" means a polymer having branch points that connect three or more chain segments. The degree of branding may be determined by $^{13}C$ NMR based on a known literature method described in *Macromolecules,* 1999, 32, 4240. As used herein, a branched polymer includes hyperbranched and dendritic polymers.

"Cooking liquor" means any pulp bearing fluids such as solutions or liquors used in pulping processes, consisting but not limited a list of white liquor, black liquor, blown liquor, red liquor, any other spent liquor, solvents, water or any combination thereof.

"Cyclic" means a polymer having cyclic or ring structures. The cyclic structure units can be formed by intramolecular cyclization or any other ways.

"Degree of branching" or DB means the mole fraction of monomer units at the base of a chain branching away from the main polymer chain relative to a perfectly branched dendrimer, determined by $^{13}$ C NMR based on a known literature method described in *Macromolecules,* 1999, 32, 4240. Cyclic units or branched alkyl chains derived from fatty alcohols or fatty acids are not included in the degree of branching. In a perfect dendrimer the DB is 1 (or 100%).

"Degree of cyclization" or DC means the mol fraction of cyclic structure units relative to the total monomer units in a polymer. The cyclic structure units can be formed by intramolecular cyclization of the polyols or any other ways to incorporate in the polyols. The cyclic structure units comprise basic structure units (V, VI and VII of FIG. 2) and the analogues thereof. The degree of cyclization may be determined by $^{13}C$ NMR.

"Extractives" means wood extractives consisting of resin acids, fatty acids, sterols and sterol esters.

"Glycerol-based polymers" means any polymers (including copolymers) containing repeating glycerol monomer units such as polyglycerols, polyglycerol derivatives, and a polymer consisting of glycerol monomer units and at least another monomer units to other multiple monomers units regardless of the sequence of monomers unit arrangements. In embodiments, glycerol-based polymers include alkylated, branched, cyclic polyglycerol esters.

"Hyperbranched" means a polymer, which is highly branched with three-dimensional tree-like structures or dendritic architecture.

"Interface" means the surface forming a boundary between the phase of wood chips and the phase of liquor undergoing digestion. Surfactants facilitate the delivery of digestion chemicals to the interface.

"Kappa number" means a measurement of the degree of deli reification that occurred during digestion as determined according to the principles and methodology defined in the scientific paper: *Kappa Variability. Roundtable: Kappa Measurement,* 1993 *Pulping Conference Proceedings*, by Fuller W. S., (1993), TAPPI Technical Paper.

"Lipohydrophilic glycerol-based polymers" means glycerol-based polymers having lipophilic and hydrophilic functionalities, for example, lipohydrophilic polyglycerols resulting from lipophilic modification of polyglycerols (hydrophilic) in which at least a part of and up to all of the lipophilic character of the polymer results from a lipophilic carbon hearing group engaged to the polymer but not being an alkoxylate group, the lipophilic modification being one such as alkylation, and esterification modifications.

"Papermaking process" means a method of making paper products from pulp comprising forming an aqueous cellulosic papermaking furnish, draining the furnish to form a sheet and drying the sheet. The steps of forming the papermaking furnish, draining and drying may be carried out in any conventional manner generally known to those skilled in the art. The papermaking process may also include a pulping stage, i.e. making pulp from a lignocellulosic raw material and bleaching stage, i.e. chemical treatment of the pulp for brightness improvement.

"Substituted" means that any atom(s) such as one hydrogen on the designated atom or group is replaced with another atom(s) or group provided that the designated atom's normal valence is not exceeded.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims.

In at least one embodiment, an additive is added to the liquor of a wood chip digestion process, which improves the pulp yield. The liquor may be white liquor, black liquor, blown liquor, red liquor, any other spent liquor, solvents, water or any combination thereof. The additive comprises at least one cross-linked glycerol based polymer. The crosslinked glycerol-based polymers may be produced by a crosslinking reaction with or without a catalyst. The glycerol-based polymers used may be polyglycerols, lipohydrophilic polyglycerols, any other glycerol-based polymer or any combination thereof. The cross-linked polymers may be added to the cooking liquor while in a solution or in a liquid carrier. The crosslinked polymers may be added or sprayed on the woodchips.

The additive is compatible and stable both in high temperatures and when in the presence of a highly alkaline environment. The additive may be a solution and can be used in a number of digestion processes including Kraft digestion, sulfite pulping, oxygen pulping, semichemical pulping, mechanical pulping, thermal pulping, thermomechanical pulping, pulping designed for conversion into synthetic fibers (such as dissolving grade pulps), and any combination thereof. The cross-linked polymer may be at least in part cyclic and may be added to pulp slurry in the papermaking process. The pulp may comprise virgin wood cellulose fibers as well as bleached or unbleached Kraft, sulfite pulp or other chemical pulps, and groundwood (GW) or other mechanical pulps such as, for example, thermomechanical pulp (TMP).

Figure 2:
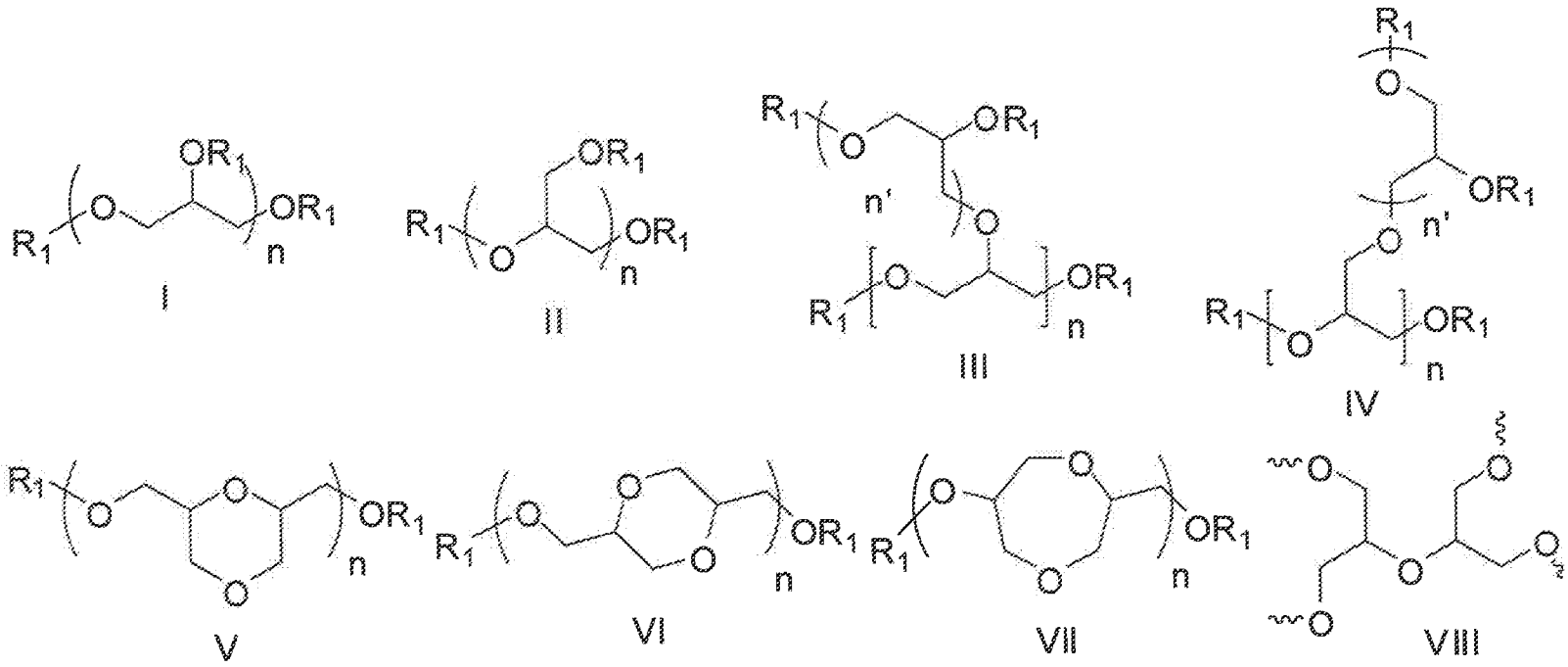
FIG. 2 is an illustration of basic structural units making up the glycerol-based polymer.
Figure 3:
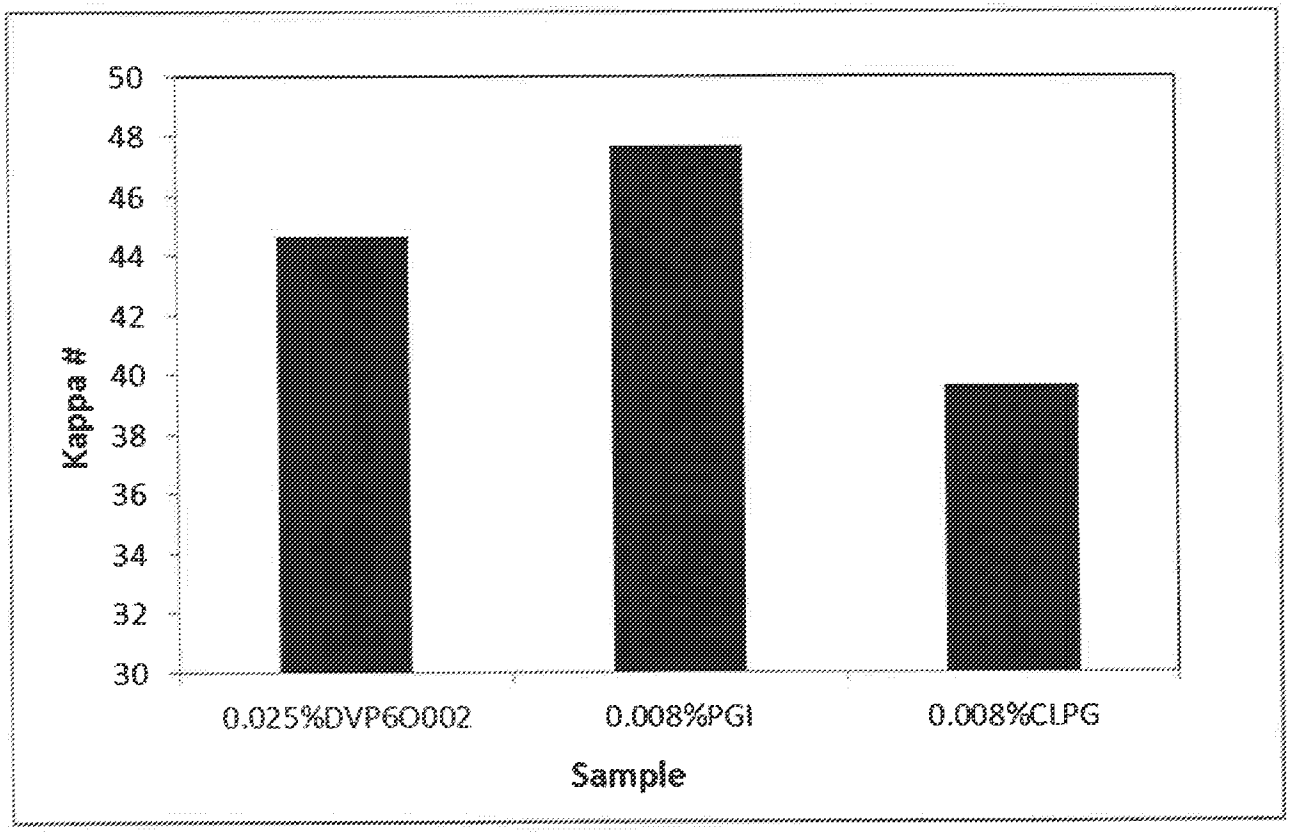
FIG. 3 is an illustration of performance data represented in terms of the kappa number of fresh wood pulp digestion in the presence of the inventive composition.
Figure 4:
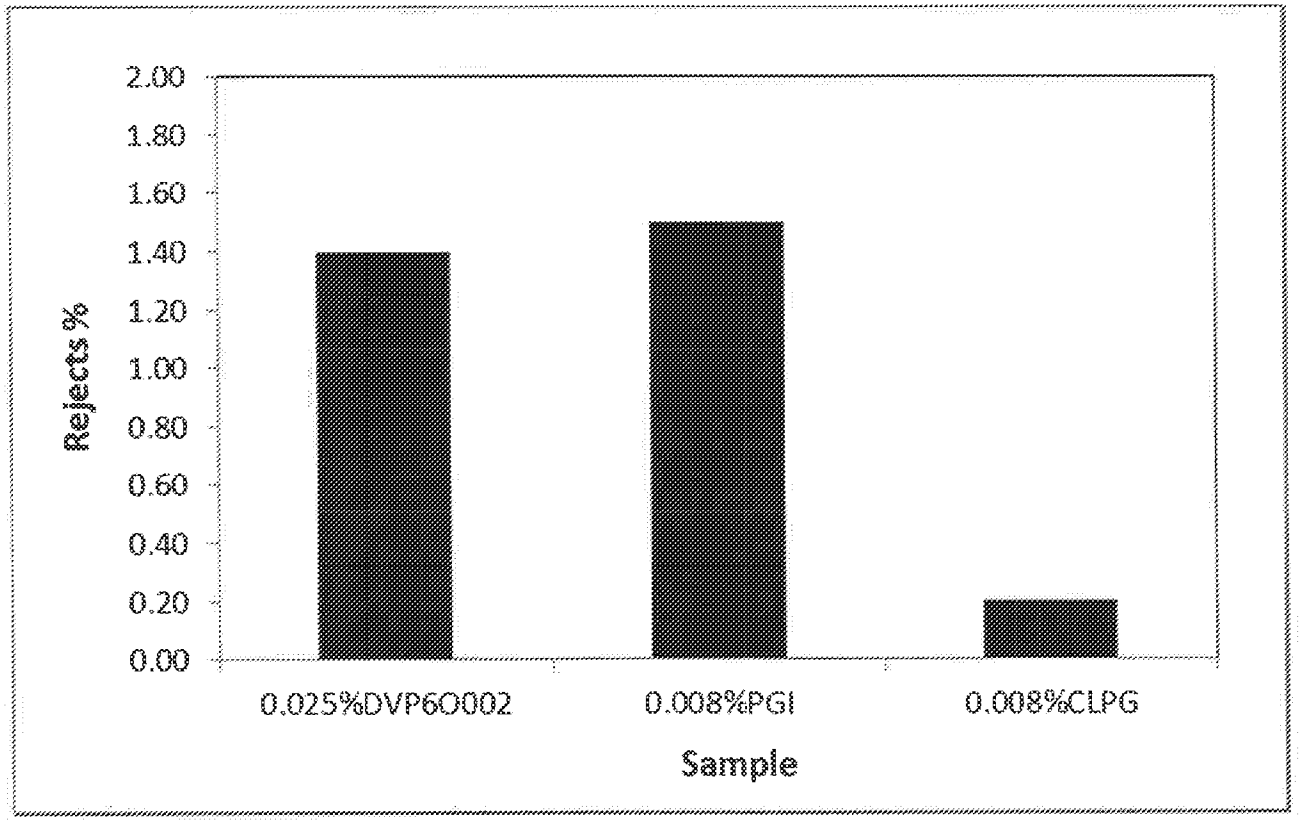
FIG. 4 is an illustration of performance data represented in terms of percentage of rejects of fresh wood pulp digestion in the presence of the inventive composition.
Figure 5:
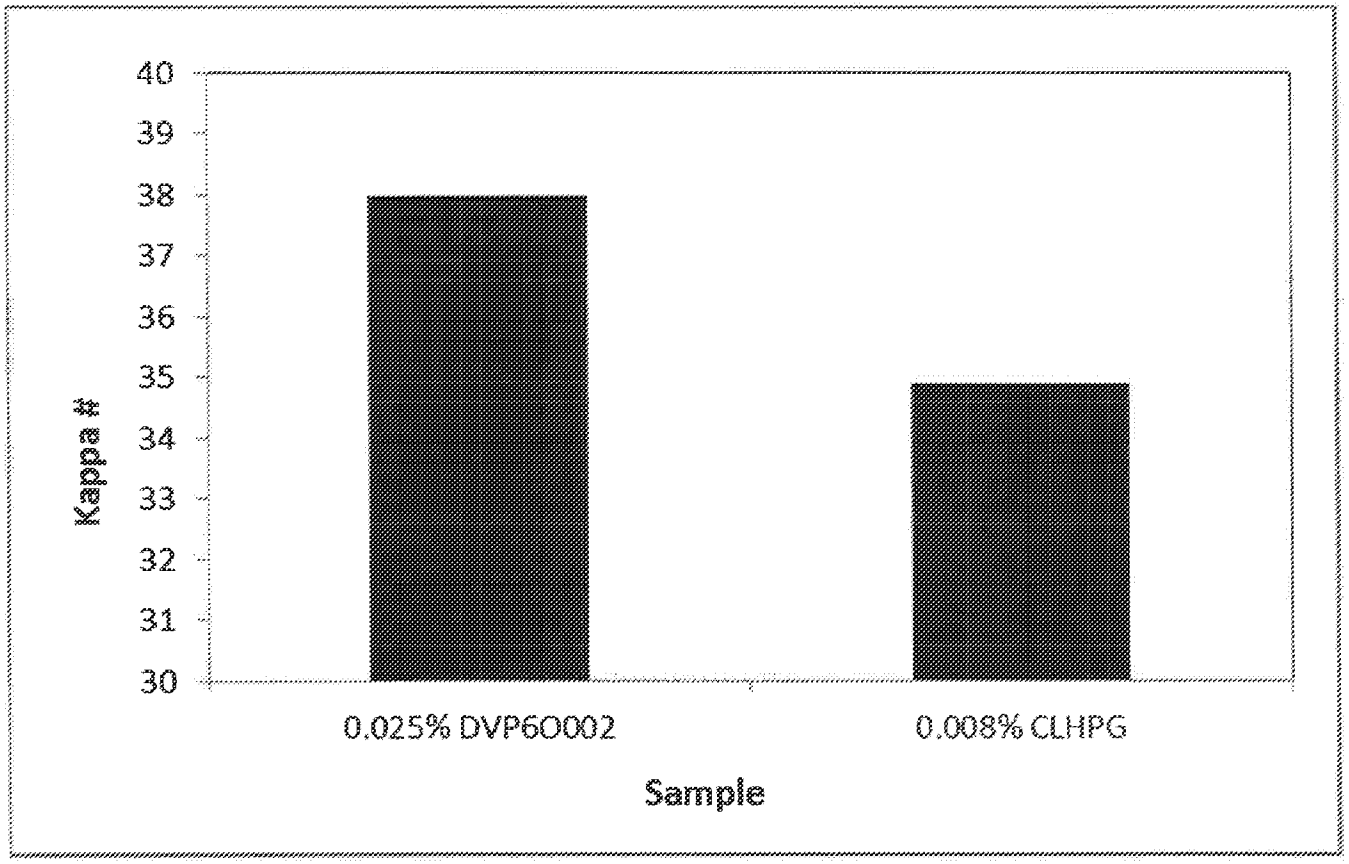
FIG. 5 is an illustration of performance data represented in terms of the kappa number of aged wood pulp digestion in the presence of the inventive composition.
Figure 6:
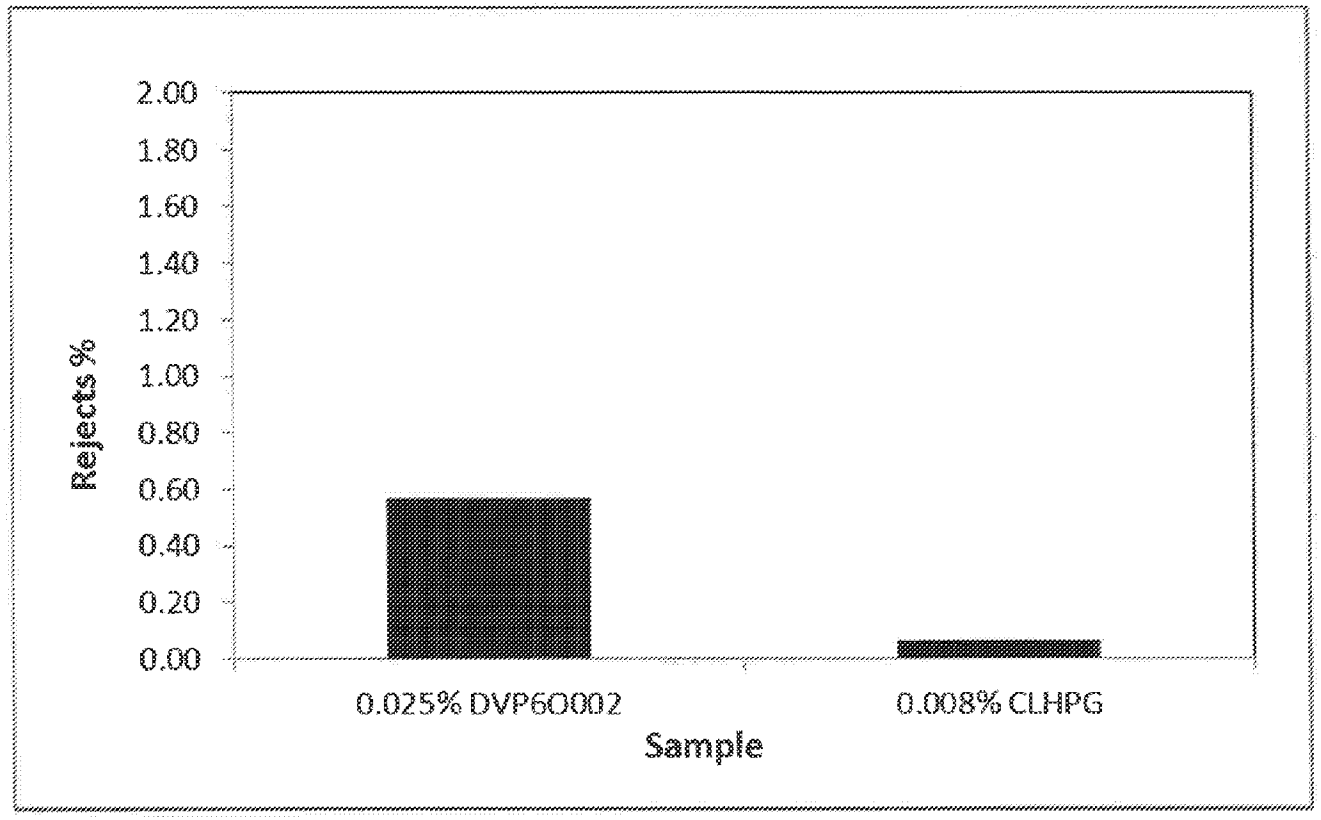
FIG. 6 is an illustration of performance data represented in terms of percentage of rejects of aged wood pulp digestion in the presence of the inventive composition.

The cross-linked polymer is made up of two or more linked polymers containing repeating glycerol (and/or glycerol based) monomer units such as polyglycerols, polyglycerol derivatives, and polymers consisting of glycerol monomer units and at least one other monomer unit, regardless of the sequence of monomers unit arrangements. Suitably, other monomers may be polyols or hydrogen active compounds such as pentaerythrital, glycols, amines, etc. capable of reacting with glycerol or any polyglycerol structures. Some examples of monomer structural units that may be present in the polymer are illustrated in FIG. 2. The glycerol based polymers may be linear, cyclic, and/or branched.

In at least one embodiment the glycerol-based polymers are cross-linked without a crosslinking reagent, such as by a condensation reaction of expelling water between at least two polymer molecules, such as described in U.S. patent application Ser. Nos. 13/484,526 and 13/560,771. In such cases Z in FIG. 1 would be 0. The self-crosslinking reaction may be done by a thermal condensation, a catalytic condensation or any combination thereof.

In at least one embodiment the glycerol-based polymers are cross-linked by reaction with at least one crosslinking reagent, such as described in U.S. Pat. No. 7,671,098 and U.S. Pat. No. 8,298,508. The crosslinking may be done by a thermal condensation, a catalytic condensation or any combination thereof. The crosslinking may occur between at least two polymer molecules through at least one crosslinking reagent. For example, a hydroxyl group on one of the polymer molecules reacts to a crosslinking reagent such as epichlorohydrin, and the attached crosslinking reagent on the polymer reacts to a hydroxyl group on another polymer molecule, to form a crosslinked polymer. For example, Z is at least 1 in FIG. 1. Suitable crosslinking agents may include at least two reactive groups such as double bonds, aldehydes, epoxides, halides, and the like. For example, a cross-linking agent may have at least two double bonds, a double bond and a reactive group, or two reactive groups. Non-limiting examples of such agents are diisocyanates, N,N-methylenebis(meth)acrylamide, polyethyleneglycol di(meth)acrylate, glycidyl(meth) acrylate, dialdehydes such as glyoxal, di- or tri-epoxy compounds such as glycerol diglycidyl ether and glycerol triglycidyl ether, dicarboxylic acids and anhydrides such as adipic acid, maleic acid, phthalic acid, maleic anhydride and succinic anhydride, phosphorus oxychloride, trimetaphosphates, dimethoxydimethsilane, tetraalkoxysilanes, 1,2-dichloroethane, 1,2-dibromoethane, dichloroglycerols 2,4,6-trichloro-s-triazine, epichlorohydrin, and any combination thereof.

In at least embodiment any of the hydroxyl groups on the glycerol-based polymers can participate in the crosslinking reaction to form the crosslinked polymers.

In the cross-linked polymers the ratio of cross linkages to basic repeating structural units may range from 0.000001:1 to 0.99999999:1.

The glycerol-based polymers (including lipophilic modified polymers) used to produce the corresponding cross-linked polymers may be from commercially available suppliers, from syntheses according to known prior arts such as described in U.S. Pat. Nos. 3,637,774, 5,198,532 and 6,765,082 B2, U.S. published patent applications 2008/0306211 A1, and 2011/0092743, and U.S. patent application Ser. No. 12/582,827, and/or from any combinations thereof.

In at least one embodiment, the glycerol-based polymer may be modified with a lipophilic group, e.g., alkylated or esterified. Representative examples of alkylation of polyols are described in German patent application DE 10,307,172 A1, in Canadian patent CA 2,613,704 A1, in U.S. Pat. No. 6,228,416 and in a scientific paper of *Polymer International,* 2003, 52, 1600-1604 and the like. Representative examples of esterificaton of glycerol-based polyols are described in U.S. Pat. No. 2,023,388, U.S. published patent application 2006/0286052 A1 and the like. The esterification may be carried out with or without a catalyst such as acid(s) or base(s).

In at least one embodiment the (lipophilic and/or non-lipophilic) glycerol based polymers are a random/statistical collection of numerous types of gylcerol-based polymers. As a result, knowing exactly where and which R1 groups exist on the polymer chain is extremely difficult to determine precisely due to the complexity, random arrangement, and statistical distributions of the R1 groups along the polymer. Mechanistically all hydroxyl groups on the polyglycerol are reactive to esterification and alkylation though the terminal hydroxyl groups may be subject to steric based favorability.

Glycerol based polymers having both lipophilic and hydrophilic portions are not in and of themselves new. They are at least somewhat mentioned in the polyoxyalkylene polymers described in U.S. Pat. No. 5,728,265. In these prior art polymers an alkyl group is located on an alkoxylate group stemming from one of the polyglycerols monomers. In the instant invention however the lipophilic character of the polymer results from a lipophilic carbon bearing group engaged to the polymer but not being located on an alkoxylate group. Furthermore this character is further enhanced by cross-linking of the polymers. As the subsequent data shows, this results in unexpectedly superior results.

Without being limited to theory it is believed that one advantage of using lipohydrophilic glycerol based polymers that it has a particularly advantageous balance between hydrophilic and hydrophobic regions, which are especially suited to the surface region of wood chips in a white liquor environment. This balance allows the additive to occupy just the right position relative to the wood chip surface and deliver greater amounts of digestion chemicals to the wood chips than other less balanced surfactants can.

In addition, the branched nature and the resulting 3-dimensional distribution of the particular regions of the cross-linked glycerol-based polymers both allows them to better reside at the interface and to better deliver digestion chemicals to the wood chips.

In at least one embodiment, the digestion aid is cross-linked glycerol-based polymers, including one or more of: polyglycerols, lipohydrophilic polyglycerols, polyglycerol derivatives, lipohydrophilic polyglycerol derivatives, other glycerol-based polymers consisting at least one glycerol monomer unit and at least another to multiple monomers units regardless of the arrangements of monomers units, other lipohydrophilic glycerol-based polymers consisting at least one glycerol monomer unit and at least another to multiple monomers units regardless of the arrangements of monomers units, and any combination thereof.

In at least one embodiment, at least one of the glycerol-based polymers in a cross-linked network is linear, branched, hyperpbranched, dendritic, cyclic and any combinations thereof. In at least one embodiment, the network of cross-linked polymers comprises three or more glycerol-based polymers. In at least one embodiment at least one polymer chain has multiple cross-linkages to another polymer. These multiple cross linkages can join a polymer multiple times to another one polymer or to more than one other polymers.

In at least one embodiment, the additive reduces the surface tension at the wood chip-white liquor interface substantially while it is within a dosage of only 0005-0.008 weight % of additive relative to the weight of the wood chips.

In at least one embodiment, the additive lowers the surface tension of water from 71.9 Nm/g (in the absence of any additive) to 23.5-26.8 Nm/g.

In at least one embodiment the additive solution reduces the kappa number of the resulting pulp.

In at least one embodiment, the amount of additive needed is far less than of comparable surfactants as described in U.S. Pat. No. 7,081,183.

In at least one embodiment, the additive can be used with other additives including but not limited to anthraquinone, anthraquinone derivatives, quinone derivatives, polysulfide and the like.

In at least one embodiment, the additive is an effective aid for deresination and delignification in improving wood chip cooking processes.

EXAMPLES

The foregoing may be better understood by reference to the following Examples, which are presented for purposes of illustration and are not intended to limit the scope of the invention:

Example 1

Synthesis of a Glycerol-Based Polymer

100 Units (or using different amounts) of glycerol were added to a reaction vessel followed by 3.0 to 4.0% of active NaOH relative to the reaction mixture. This mixture was agitated and then gradually heated up to 240° C. under a particular low reactivity atmospheric environment of nitrogen flow rate of 0.2 to 4 mol of nitrogen gas per hour per mol of monomer. This temperature was sustained for at least three hours to achieve the desired polyglycerol composition (Table 1), while being agitated under a particular low reactivity atmospheric environment. An in-process polyglycerol sample was drawn before next step for the molecular weight/composition analysis/performance test.

TABLE 1

Examples of Glycerol-Based Polymers

| Sample ID | Molecular weight (Daltons)* | Lactic acid weight by NMR** | Degree of branching** |
|---|---|---|---|
| PGI | 6,100 | 15% | 0.32 |
| PGII | 7,800 | 14% | 0.34 |

Note:
*Determined by borate aqueous SEC (size exclusion chromatography) method and calibrated with PEO/PEG standards;
**determined by $^{13}C$ NMR which is consistent with HPLC results.

Example 2

Synthesis of a Crosslinked Glycerol-Based Polymer

Polyglycerol from the example 1 (PGI) was dissolved in water as 30-60% solution. To the polyglycerol solution was added 50% NaOH solution (1-15% relative to PGI) at room temperature. After mixing, epichlorohydrin (1-15% relative to PGI) was added, and the resulting reaction mixture was agitated at room temperature for hours until the desired crosslinked glycerol-based polymer formed. The molecular weight of the product was analyzed by SEC (Table 2, CLPG—crosslinked polyglycerol).

TABLE 2

Examples of Crosslinked Glycerol-Based Polymers

| Sample ID | Polyglycerol used | Molecular weight (Daltons) | Lactic acid weight by HPLC*** |
|---|---|---|---|
| CLPG | PGI | 55,000* | NA |
| CLHPG | PGII | 18,000** | 0.56% |

Note:
*Determined by borate aqueous SEC (size exclusion chromatography) method and calibrated with PEO/PEG standards.
**Weight average molecular weight determined by SEC method using PLgel Guard Mixed-D column and DMSO as mobile phase, and calibrated with polysaccharide standards.
***Determined by HPLC external standard quantification.

Example 3

Synthesis of a Crosslinked Lipohydrophilic Glycerol-Based Polymer

To the polyglycerol from the example 1 (PGII) was added $H_2SO_4$ (10-22% relative to PGII) at 100-125° C., while agitation under a low reactivity atmospheric environment. The mixture was gradually heated up to 130° C.-150° C. and kept there for at least 30 minutes under a particular low reactivity atmospheric environment, to achieve the desired esterification, C10-C16 alcohols (1-15% relative to PGII) were added. The mixture was heated up to 150° C. and kept there under a particular low reactivity atmospheric environment for at least 30 minutes to achieve the desired alkylation. The resulting reaction mixture was stirred at 150° C. under a particular low reactivity atmospheric environment for at least 30 minutes to achieve the crosslinking to produce the desired end product. The product was dissolved in water (50%) (Table 2, CLHPG—crosslinked lipohydrophilic polyglycerol). During the whole process in-process samples were drawn every 30 minutes to 2 hours as needed to monitor the reaction progress and determine the composition as needed.

Example 4

Kappa Number and Rejects

Aged or fresh softwood chips from a midwestern mill were used. Cooking experiments were performed on 20 g of wood at 4:1 liquor to wood ratio, with 15% alkali and 25% sulfidity charge. The alkali was sourced from sodium hydroxide (70%) and sodium sulfide (30%). Weak black liquor (~20% solids) was used to makeup liquid. Digester additives were added to the black liquor, which was mixed well and then combined with the white liquor. All cooks began at 55° C. and the temperature was quickly ramped to 170° C. for a total cooking time of 3 hours. After that, the cooking capsules were placed under cold running water for approximately 10 minutes. The contents were then transferred to cheesecloth and squeezed under warm water to remove the majority of cooking liquor. The pulp was then diluted with warm tap water to 800 mL and disintegrated in Waring blender for 30 seconds. The resulting slurry was transferred to cheesecloth and washed three times with 800 mL of warm tap water. The pulp was broken down by hand into small pieces and all rejects were removed manually. The resulting pulp was oven dried overnight and weighted. The pulp was allowed to dry in the CTH room for 4 days to an average consistency of 92%. Kappa numbers were determined using TAPPI test method T 236.

The performance of crosslinked glycerol-based polymers was compared with a prior art alkyl polyalkylene glycol surfactant (DVP6O002) described in U.S. Pat. No. 7,081,183B2 (Tables 3 and 4, and FIGS. 3-6).

TABLE 3

Digestion Performance with Aged Wood Chips

| Sample ID | Surfactant wt % | Kappa # | Rejects wt % |
|---|---|---|---|
| DVP6O002 | 0.025% | 44.63 | 1.40% |
| PGI | 0.008% | 47.63 | 1.50% |
| CLPG | 0.008% | 39.61 | 0.20% |

TABLE 4

| Digestion Performance with Fresh Wood Chips | | | |
|---|---|---|---|
| Sample ID | Surfactant wt % | Kappa # | Rejects wt % |
| DVP6O002 | 0.025% | 37.98 | 0.57% |
| CLHPG | 0.008% | 34.89 | 0.06% |

While this invention may be embodied in many different forms, there are shown in the drawings and described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and incorporated herein.

Any ranges given either in absolute terms or in approximate terms are intended to encompass both, and any definitions used herein are intended to be clarifying and not limiting. All ranges and parameters disclosed herein are understood to encompass any and all subranges (including all fractional and whole values) subsumed therein, and every number between the endpoints. For example, a stated range of "1 to 10" should be considered to include any and all subranges between (and inclusive of) the minimum, value of 1 and the maximum value of 10; that is, all subranges beginning with a minimum value of 1 or more, (e.g. 1 to 6.1), end ending with a maximum value of 10 or less, (e.g. 2.3 to 9.4, 3 to 8, 4 to 7), and finally to each number 1, 2, 3, 4, 5, 6, 7, 8, 9, and 10 contained within the range. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method for enhancing the penetration of cooking liquor into wood chips, the method comprising cooking wood chips in a cooking liquor to form a paper pulp and including at least one cross-linked glycerol-based polymer comprising additive in the cooking liquor, the method so enhances the penetration of pulping liquor into the chips that it reduces lignin such that the resulting pulp has a lower kappa number than if no polymer or if equal amounts of other glycerol based polymers were added to the liquor.

2. The method of claim 1 in which the polymer has a branched structure, the branched structure characterized as having at least three chain segments of the polymer joined at a single joining monomer of the polymer which has an alkoxylate group.

3. The method of claim 2 in which at least one of the chain segments comprises a lipophilic carbon bearing group and this chain segment is engaged to the joining monomer at a location other than the alkoxylate group of the joining monomer.

4. The method of claim 1 wherein the additive is a cross-linked glycerol-based polymer having branched and cyclic structures according to the structure:

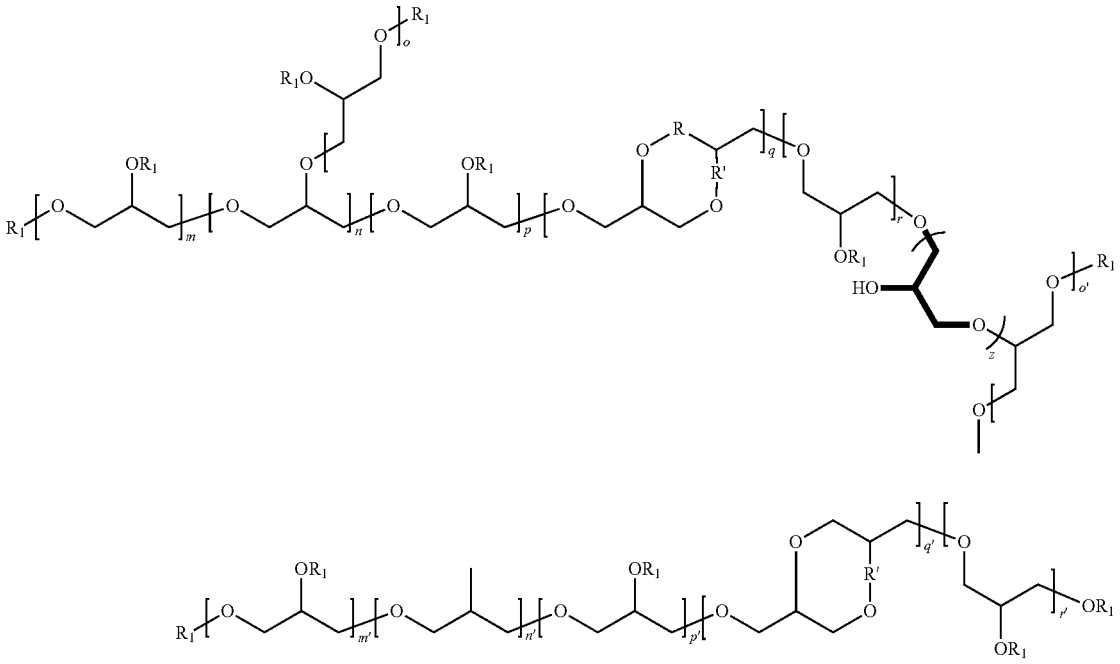

wherein m, n, o, and p are each independently between 1 and 700 and q and r are independently a number of 0 and integers of between 1-700, R and R' are (CH2)n and n can independently be 1 or 0, Z can be 0 or great than 0 and each R1 is independently H, acyl, or a C1-C40 hydrocarbon group, which may be optionally substituted.

5. The method of claim 1 wherein the additive consists essentially of a cross-linked lipohydrophilic polyglycerol solution.

6. The method of claim 1 wherein the additive is selected from the list of crosslinked lipohydrophilic, crosslinked polyglycerols, crosslinked polyglycerol derivatives, and other crosslinked glycerol-based polymers and any combinations thereof.

7. The method of claim 1 wherein the glycerol-based polymers, are branched, hyperbranched, dendritic, cyclic and any combinations thereof.

8. The method of claim 1 wherein the additive is added to the cooking liquor in an amount of less than 1% based on the dried weight of the chips.

9. The method of claim 1 in which the additive reduces the amount of lignin in the produced paper pulp by at least at least 0.5%.

10. The method of claim 1 in which the digestion process is one selected from the list consisting of: Kraft digestion, sulfite pulping, oxygen pulping, semichemical pulping, mechanical pulping, thermal pulping, thermomechanical pulping, pulping designed for conversion into synthetic fibers such as dissolving grade pulps, and any combinations thereof.

11. The method of claim 1 in which the cooking liquor also may comprise additional surfactant(s).

12. The method of claim 1 in which the cross-linked glycerol-based polymers can be used by combining with anthraquinone, anthraquinone derivatives, quinone derivatives, polysulfide and the like and any combinations thereof.

13. The method of claim 1 in which the cross-linked glycerol-based polymers comprises at least one of the structural units illustrated in FIG. 2.

14. The method of claim 1 in which the cross-linked glycerol-based polymers comprises copolymers containing non-glycerol based structural units.

15. A method for enhancing the penetration of cooking liquor into wood chips, the method comprising cooking wood chips in a cooking liquor to form a paper pulp and including at least one cross-linked lipohydrophilic glycerol-based polymer additive in the white liquor, wherein the polymer has a branched structure, the branched structure characterized as having at least three chain segments of the polymer joined at a single joining monomer of the polymer which has an alkoxylate group, and in which at least one of the chain segments comprises a lipophilic carbon bearing group and this chain segment is engaged to the joining monomer at a location other than the alkoxylate group of the joining monomer, the method so enhances the penetration of pulping liquor into the chips that it reduces lignin, such that the resulting pulp has a lower kappa number than if no polymer or if equal amounts of other glycerol based polymers were added to the liquor.

16. The method of claim 1 wherein the additive consists essentially of a cross-linked polyglycerol solution.

17. The method of claim 1 wherein the cooking liquor is white liquor.

18. The method of claim 1 wherein the crosslinked glycerol-based polymer increases the pulping yield.

19. The method of claim 1 in which the cooking liquor is black liquor.

* * * * *